United States Patent [19]

Canup et al.

[11] 4,047,783

[45] Sept. 13, 1977

[54] ELECTRICAL TERMINAL CONNECTOR

[75] Inventors: Robert E. Canup, Poughkeepsie, N.Y.; Earl W. McPeak, Jr., Powhatan, Va.

[73] Assignee: Texaco Inc., New York, N.Y.

[21] Appl. No.: 661,086

[22] Filed: Feb. 25, 1976

[51] Int. Cl.[2] ..... H01R 11/20

[52] U.S. Cl. ..... 339/97 R; 174/74 R; 338/214; 338/322; 339/100

[58] Field of Search ..... 339/97–100, 339/223, 256; 174/74 R, 75 R; 338/66, 214, 322, 332

[56] References Cited

U.S. PATENT DOCUMENTS

| | | | |
|---|---|---|---|
| 459,820 | 9/1891 | Short | 339/100 |
| 593,467 | 11/1897 | Gottschalk | 339/223 S |
| 598,972 | 2/1898 | Blodgett | 339/100 |
| 1,783,554 | 12/1930 | Backer | 174/74 R |
| 1,824,447 | 9/1931 | Richter | 338/214 |
| 2,809,359 | 10/1957 | Slick | 339/100 |

FOREIGN PATENT DOCUMENTS

| | | | |
|---|---|---|---|
| 1,395,463 | 3/1965 | France | 339/100 |
| 431,557 | 7/1935 | United Kingdom | 339/100 |

*Primary Examiner*—Joseph H. McGlynn
*Attorney, Agent, or Firm*—Thomas H. Whaley; Carl G. Ries; Henry C. Dearborn

[57] ABSTRACT

A special purpose electrical connector. It is for connecting an end of a resistive type of electrical conductor so as to have maximum electrical and mechanical properties.

The resistive conductor has a resilient material core of desired resistivity which is surrounded by an insulator. A pair of conductive material wires are applied in a cooperative manner with one wire extending doubled for a substantial distance into the core. The other wire wraps around the outside of the insulator and pierces through to join the first within the resilient core, before extending axially beyond the end of the core and insulation.

7 Claims, 2 Drawing Figures

ELECTRICAL TERMINAL CONNECTOR

BACKGROUND OF THE INVENTION

1. Field of the Invention

This invention concerns a connector for electrical conductors, in general. More specifically, it concerns a particular type of electrical connector that is adapted for making a terminal connection with an insulated resistive type of conductor.

2. Description of the Prior Art

In the field of ignition cables and particularly such cables for use with internal combustion engines, and especially where the system employs high voltage ignition signals, it has been found that there is a weak point when a resistive type of ignition conductor is employed. There is a tendency for a bad electrical connection to be made at the terminal end of such a cable, and such conditions are highly conducive to electrical sparking. Such sparking will rapidly destroy the connection.

In addition, there is a requirement for ignition cables, or lead wires to have adequate mechanical strength to withstand rough handling. Use of ignition leads on an internal combustion engine involves the connections with the tips of spark plugs, and handling involves relatively great mechanical forces. Consequently, during maintainance and similar prodedures when spark plugs are disconnected and reconnected, there is a considerable mechanical force applied to the electrical lead or cable and this tends to weaken or destroy the electrical connection at the terminal end of the ignition cable.

It is an object of this invention to provide improved structure for a terminal connector, such that the electrical and mechanical properties which are subject to the difficulties mentioned above, may be overcome.

Another object of the invention, is to provide a terminal connector for use in combination with a shielded resistive-type ignition cable. The combination includes an adapter for making the electrical and mechanical joinder with the cable, and in addition an insulating material coupling means for mechanically supporting the end of the ignition cable.

SUMMARY OF THE INVENTION

Briefly, the invention concerns an electrical connector for making a terminal connection with an insulated resistive type conductor. The connector comprises a plurality of low resistance conductors including at least one being situated for maximising electrical contact with said resistive type conductor. Another of said low resistance conductors is situated for maximising mechanical contact with the insulation of said resistive conductor. The said low resistance conductors are adapted for being bonded together.

Again briefly, the invention concerns an electrical connector for making a terminal connection with a resistive type conductor having a layer of insulation thereover. The connector comprises a pair of solid copper wires, and one of said wires is doubled back and inserted longitudinally into said resistive type conductor. The said doubled end of said one wire forms a rounded external surface and is inserted sufficiently into the core of said resistive type conductor to maximise the electrical contact therewith. The other of said wires is wrapped around the outside of said layer of insulation and pierces through at diametrically spaced locations to extend radially into the core of said resistive type conductor. The said other wire extends parallel to said doubled one wire in the core of said resistive type conductor to maximise its electrical contact, while said wrap around maximises mechanical contact. Both of said wires have the free ends thereof extending far enough out from the end of said resistive type conductor to accomodate bonding together for good electrical and mechanical contact.

Once more briefly, the invention is in combination with a shielded resistive-type high-voltage ignition cable having a resistive type conducting core surrounded by a layer of insulation. It is a terminal connector, which comprises a pair of conductive wires, one of said wires being doubled back to form rounded external surfaces and being inserted sufficiently into said core to maximise electrical contact therewith. The other of said wires is wrapped around the outside of said layer of insulation and pierces radially therethrough at diametrically spaced locations, to extend in parallel with said doubled one wire within said core. Both of said wires extend beyond the end of said core and layer of insulation. The combination includes a conductive material adapter electrically and mechanically joined to said extended portion of said wires, and insulating means which surrounds said adapter for mechanically supporting the end of said ignition cable.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENT

Resistive-type ignition leads are widely used in connection with various internal combustion engines. They are conventionally constructed using a carbon impregnated central core which is surrounded by high voltage insulation. A weak point (in the electrical sense) of such cables is the method of termination of the core of such leads. This is particularly critical in some military shielded cables, where the terminal must be compatable with existing equipment.

This invention is instrumental in overcoming two major problems which exist. First, the terminal of such ignition leads must be sufficiently strong mechanically so as to resist rough handling. And second, there must be an excellent electrical connection since any poor connection in this regard will result in arcing, which will soon destroy the connection.

Figure 1:
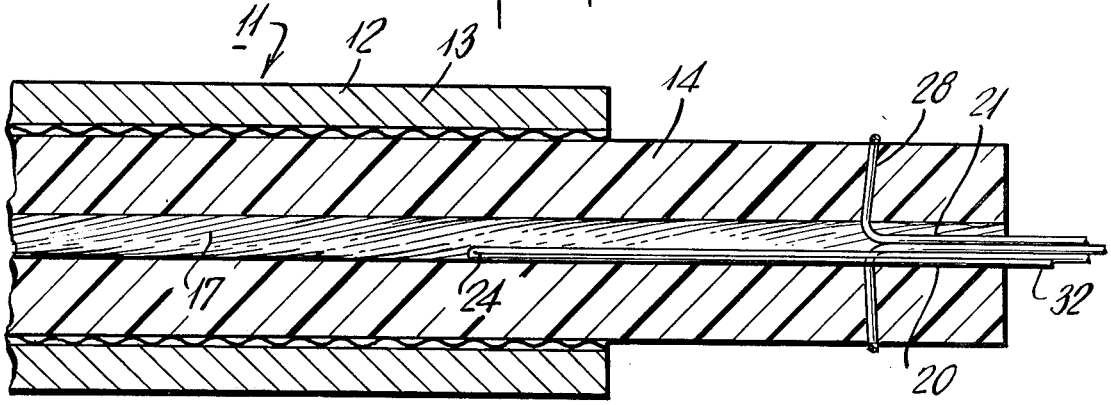
FIG. 1 is a cross-sectional schematic illustration of an electrical connector according to the invention.

Referring to FIG. 1 it will be noted that there is illustrated an ignition cable 11 which is the type that is used in military installations. It includes an outer shielding layer 12, which surrounds a layer of glass braid 13 that covers a layer of high voltage insulation 14. At the core (i.e. axial center) of the insulation 14 there is a resistive type conductor 17. This conductor 17 may be constructed of various materials, e.g. a carbon impregnated fiberglass which is coated with conductive rubber. It will be understood that this core 17 comprises the resistive type of conductor of the ignition cable 11.

The structure according to this invention includes a pair of solid copper wires 20 and 21. The wire 20 is doubled over to form a rounded end 24, and this doubled wire 20 is inserted into the core 17 for a considerable distance, as illustrated in FIG. 1. This is done in order to maximise the electrical contact between the solid conductor 20 and the resistive type core 17. It will be appreciated that the material of the core 17 is sufficiently resilient to accomodate the wire 20 while substantially surrounding the outer surfaces thereof. Furthermore, while the radially outermost half of the doubled wire 20 is illustrated as being in contact with the insulation 14 it would be preferred to have the doubled wire inserted centrally along the axis of the core 17.

The other solid copper wire 21 is wrapped around the outside of the insulation 14 longitudinally beyond the end of the shielding 12. Then it pierces through the insulation radially at two locations which are situated about 180 degrees apart. This forms a half loop wrapped portion 25 (FIG. 2) that goes from the ends of radial portions 28 and 29 of the wire 21. These portions 28 and 29 pierce through the insulation 14, as indicated, and then the wire 21 extends into the core 17 to lie parallel with the doubled wire 20.

The free ends of both of the copper wires 20 and 21 extend out beyond the end of the ignition lead wire, or cable 11. This is indicated by a reference number 32. It may be noted that these ends 32 extend far enough to accomodate being bonded together to make good electrical, as well as strong mechanical contact.

Figure 2:
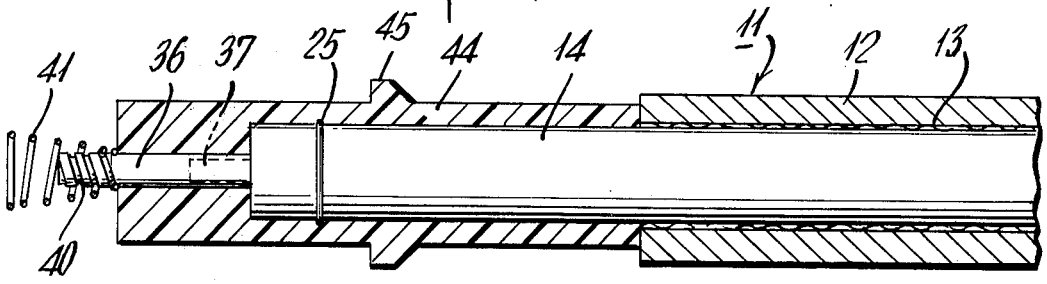
FIG. 2 is a somewhat reduced size cross-sectional view illustrating the terminal connector shown in FIG. 1, and showing it in combination with elements which particularly adapt it for use with spark plugs.

FIG. 2 illustrates the same ignition cable 11, but also includes additional elements of a more comprehensive combination according to this invention. It particularly adapts the terminal connector as it is applied to a shielded, resistive type high voltage ignition cable.

It may be noted that FIG. 2 illustrates only the shielding and outer layer of the cable in cross-section. This more clearly indicates the assembly structure of the terminal connector combination. Thus, the FIG. 2 combination illustrates a conductive material adapter 36 that has a recessed end 37 which is crimped onto the ends 32 of the wires 20 and 21 so as to make secure mechanical contact and good electrical contact at the same time.

The other end of the adapter 36 is provided with a threaded outer surface 40 in order to accomodate a spiral spring 41 which is a good electrical conductor and which is screwed onto the threaded end 40 of the adapter 36. Spring 41 is screwed into contact with the outer end of an insulating material coupling member 44.

The coupling member 44 is especially designed for use with a special type of spark plug (not shown). It has a flange 45 incorporated thereon for accomodating a threaded collar (not shown) that may be used in applying the connector combination to the end of the military type spark plug (not shown) just mentioned. It may be noted that the member 44 is made of a relatively stiff plastic or other good insulating material so as to provide mechanical support for the end of the ignition cable 11.

While a particular embodiment of the invention has been described above in considerable detail in accordance with the applicable statutes, this is not to be taken as in any way limiting the invention but merely as being descriptive thereof.

We claim:

1. An electrical connector for making a terminal connection with a resistive type conductor having a layer of insulation thereover, comprising a pair of solid copper wires, one of said wires being doubled back and inserted longitudinally into said resistive type conductor, said doubled end of said one wire forming rounded external surfaces and being inserted sufficiently into the core of said resistive type conductor to maximise the electrical contact therewith, the other of said wires being wrapped around the outside of said layer of insulation and piercing through at diametrically spaced locations to extend radially into the core of said resistive type conductor, said other wire extending parallel to said doubled one wire in the core of said resistive type conductor to maximise its electrical contact while said wrap around maximises mechanical contact, both of said wires having the free ends thereof extending far enough out from the end of said resistive type conductor to accomodate bonding together for good electrical and mechanical contact.

2. An electrical connector according to claim 1, wherein said resistive type conductor comprises a carbon impregnated fiberglass core coated with conductive rubber.

3. In combination with a shielded resistive-type high-voltage ignition cable having a resistive type conducting core surrounded by a layer of insulation, a terminal connector, comprising a pair of conductive wires, one of said wires being doubled back to form rounded external surfaces and being inserted sufficiently into said core to maximise electrical contact therewith, the other of said wires being wrapped around the outside of said layer of insulation and piercing radially therethrough at diametrically spaced locations to extend in parallel with said doubled one wire within said core, both of said wires extending beyond the end of said core and layer of insulation, a conductive material adapter electrically and mechanically joined to said extended portion of said wires, and insulating means surrounding said adapter for mechanically supporting the end of said ignition cable.

4. A terminal connector according to claim 3, wherein said adapter is crimped onto said wires.

5. A terminal connector according to claim 4, further comprising a threaded surface at the free end of said adapter, and a conductive material spring for cooperating with said threaded surface.

6. An electrical connector for making a terminal connection with an insulated resistive type conductor, comprising a plurality of low resistance conductors including at least one comprising a solid rounded external surface wire doubled back and inserted longitudinally into and surrounded by said resistance type conductor for making maximum electrical contact, another of said low resistance conductors comprising a solid wire piercing said insulation at diametrically spaced locations and extending radially through said insulation and wrapped around the outside thereof for maximising mechanical contact with the insulation of said resistive type conductor, said other of said low resistance conductors also extending into and longitudinally surrounded by said resistance type conductor for maximising electrical contact therewith, both of said low resistance conductors being adapted for being bonded together, and both said one and said other low resistance wires extending longitudinally out from the end of said resistance type conductor sufficiently to accomodate said bonding together.

7. An electrical connector according to claim 6 wherein said low resistance wires are copper.

* * * * *